US009429313B2

(12) United States Patent
Chen

(10) Patent No.: US 9,429,313 B2
(45) Date of Patent: Aug. 30, 2016

(54) STEAM GENERATOR

(75) Inventor: Chao Hui Chen, Crawley (GB)

(73) Assignee: DOOSAN BABCOCK LIMITED, Sussex (GB)

( * ) Notice: Subject to any disclaimer, the term of this patent is extended or adjusted under 35 U.S.C. 154(b) by 486 days.

(21) Appl. No.: 13/703,098

(22) PCT Filed: Jun. 14, 2011

(86) PCT No.: PCT/GB2011/051108

§ 371 (c)(1),
(2), (4) Date: Feb. 12, 2013

(87) PCT Pub. No.: WO2011/158021

PCT Pub. Date: Dec. 22, 2011

(65) Prior Publication Data

US 2013/0264827 A1 Oct. 10, 2013

(30) Foreign Application Priority Data

Jun. 16, 2010 (GB) ..... 1010038.6

(51) Int. Cl.
*F22B 29/06* (2006.01)
*F22B 37/12* (2006.01)
*F22B 37/10* (2006.01)

(52) U.S. Cl.
CPC ..... *F22B 29/061* (2013.01); *F22B 29/062* (2013.01); *F22B 37/102* (2013.01); *F22B 37/103* (2013.01); *F22B 37/12* (2013.01)

(58) Field of Classification Search
CPC .. F22B 29/061; F22B 29/062; F22B 37/102; F22B 29/06; F22B 37/12
USPC ..... 122/235.23, 235.33, 235.12, 235.14
See application file for complete search history.

(56) References Cited

U.S. PATENT DOCUMENTS

| | | | | |
|---|---|---|---|---|
| 2,232,935 | A * | 2/1941 | Bailey | 122/328 |
| 3,301,224 | A * | 1/1967 | Ambrose | 122/406.4 |
| 3,556,059 | A | 1/1971 | Gorzegno | |
| 3,670,703 | A * | 6/1972 | Michel | 122/406.1 |
| 4,033,320 | A * | 7/1977 | Jury | F24H 3/087 126/110 R |
| 4,948,468 | A * | 8/1990 | Reeves | C10B 53/06 202/121 |
| 5,101,773 | A * | 4/1992 | White | 122/235.13 |
| 5,701,850 | A | 12/1997 | Kohler et al. | |
| 5,979,370 | A | 11/1999 | Franke | |
| 6,189,491 | B1 | 2/2001 | Wittchow et al. | |
| 6,536,380 | B1 | 3/2003 | Kral et al. | |

FOREIGN PATENT DOCUMENTS

| | | |
|---|---|---|
| GB | 1 251 815 | 11/1971 |
| GB | 1251815 | * 11/1971 |

* cited by examiner

*Primary Examiner* — Alissa Tompkins
*Assistant Examiner* — Benjamin W Johnson
(74) *Attorney, Agent, or Firm* — Sughrue Mion, PLLC

(57) ABSTRACT

A steam generator (2) is described in which a combustion chamber has at least one combustion chamber wall formed by a plurality of longitudinal furnace tubes (10) for passage of an evaporatable flow medium, connected together in gas-tight manner by tube webs. As will be familiar different tubes are likely to be subjected to a heat input in use that varies when the combustion chamber is fired. The tube bores of the furnace tubes are larger where subject to higher heat input than where subject to lower heat input. In particular the tube bores of the furnace tubes are generally larger in the middle region of the combustion chamber wall than at the transversely peripheral regions of the combustion chamber wall.

25 Claims, 4 Drawing Sheets

STEAM GENERATOR

The invention relates to a furnace tube arrangement for a steam generator. The invention in particular relates to a steam generator for once-through or continuous-flow operation, in which a furnace wall comprises furnace tubes arranged longitudinally in parallel in a furnace wall direction (and for example disposed vertically) which are connected together in gas-tight manner via tube webs, and along which an evaporatable flow medium (for example water/steam) can flow in a furnace wall direction (and for example from the bottom to the top).

The invention in particular relates to a steam generator in a thermal power plant which is fired by a plural array of burners for carbonaceous fossil fuels, including solids and especially pulverized solids, liquids, emulsions and gases.

In a once-through steam generator the heating of furnace tubes forming the combustion chamber walls leads to a complete evaporation of the flow medium in the tubes in a single pass. A once-through steam generator may have vertically or spirally disposed furnace tubes, but a vertical tube steam generator is often preferred as generally of simpler construction and as exhibiting lower water-side/steam-side pressure losses than a steam generator with spiral tubes. However, this can lead to problems associated with the varied thermal profile experience by different tubes making up the furnace wall.

The tube arrangement in a vertical tube steam generator comprises a plurality of generally straight vertical tubes. In a typical case, a plurality of parallel tubes are connected together in gas-tight manner via tube webs to define a furnace wall and a plurality of such walls define a combustion chamber of polygonal and for example rectangular cross-section. Flow medium flows from one end to the other, for example vertically from bottom to top. Burners fire the combustion chamber through burner throats let into the furnace wall. The steam generator may be a vertical arrangement fired by burners arranged at the lower part of the combustion chamber and with a vertical gas flue towards the top of the combustion chamber, or a horizontal arrangement fired via burners generally level with a horizontal gas flue. The invention is applicable to both arrangements.

The burners do not heat the combustion chamber volume entirely uniformly. However the burners are distributed, the flames they produce will be unlikely to fill the entire volume of the combustion chamber in uniform manner. In practice, temperature will reduce away from the burners and will thus tend to reduce towards the edges of a burner wall and towards the corners of a polygonal combustion chamber, and be higher towards the middle of the walls, away from the corners of a polygonal combustion chamber. Thus, tubes towards the middle tend to experience hotter conditions than tubes at the corners. Additionally, some tubes may experience hotter conditions because of their specific geometry such as by virtue of their location at a burner throat.

As a result, the heat flux at an individual furnace tube depends in particular on its position in the combustion-chamber wall. In the case of spiral tubes these effects are mitigated. But in the case of a combustion chamber having longitudinal rather than spiral tubing, these effects tend to be perpetuated along the tube length but the profile may get flatter away from the burners fired. Thus a furnace tube in a corner of the combustion chamber experiences a lower gas-side heat-flow density over its entire length than a furnace tube in the middle of a combustion-chamber wall. In uniform water/steam flow conditions there is a greater supply of heat into the furnace tubes in the middle of the combustion-chamber walls than in the region of the corners of the combustion chamber. If tubes are of otherwise equivalent design in these different areas, this leads to the potential of higher metal temperatures in more highly heated tubes. Such non-uniform conditions hinder the efficient and safe operation of the steam generator.

Similar considerations may arise where parallel tube arrangements are disposed otherwise than vertically. The principle of the invention can apply to any case where heat inputs to the tubes of the furnace enclosure walls vary perpendicular to the tubes and where there is a consequent desire for a more closed match of the flows and the heat inputs of individual tubes.

A solution is proposed in U.S. Pat. No. 5,979,370, whereby the furnace tube arrangement is modified such that the combined heat absorbing surface of a given furnace tube and its associated tube web is smaller in the middle region of the combustion-chamber wall and larger at the corners. This is suggested as a means to equalize the effect of lower gas-side heat flux at the corners.

U.S. Pat. No. 5,979,370 suggests two specific structures in particular to achieve this objective. First, the pitch of the tubes may be varied to be more closely arrayed towards the middle. Second, the diameter of the tubes may be varied to be larger at the corners. Although both structures meet the requirement that the combined heat absorbing surface of a given furnace tube and its associated tube web is smaller in the middle region of the combustion-chamber wall and larger at the corners there is a problem with the latter approach. For otherwise uniform once-through flow conditions, the larger diameter furnace tubes at the corners will experience higher mass flows that will more than offset the effect of increased heat absorbing surface. The temperature differential between tubes towards the middle and tubes towards the corners will not be equalized and is likely to be exacerbated.

In accordance with the invention in a first aspect, a steam generator comprises at least one combustion chamber wall comprising a plurality of longitudinally disposed furnace tubes together comprising a single fluid system for parallel passage from a common source to a common outlet of an evaporatable flow medium, connected together in gas-tight manner by tube webs;

wherein the combustion chamber is so arranged that different tubes are subjected to different heat input levels in use when the combustion chamber is fired;

and wherein the tube bores of at least some furnace tubes subject to higher heat input are larger than the tube bores of at least some furnace tubes subject to lower heat input.

The invention particularly provides a combustion chamber comprising a plurality of combustion chamber walls to define a combustion chamber of polygonal and for example rectangular cross-section at least one of which is a combustion chamber wall as above described.

In one particular embodiment the invention is applied to a combustion chamber so arranged that different tubes are subjected to heat input levels in use when the combustion chamber is fired which vary in a direction transverse to a tube longitudinal direction, and in the case of this embodiment the tube bores of the furnace tubes vary in like manner in a direction transverse to a tube longitudinal direction such that the tube bores of at least some furnace tubes subject to higher heat input are larger than the tube bores of at least some furnace tubes subject to lower heat input.

The invention may be particularly applied to a vertical tube combustion chamber in which plural tubes are arranged generally vertically. In such a case heat input levels in use when the combustion chamber is fired may vary in a horizontal direction along the chamber wall and the tube bores of the furnace tubes vary in like manner in a horizontal direction along the chamber wall. Examples of such a case are discussed below. However the principle of the invention can be applied to any case where the heat inputs to the tubes of the furnace enclosure walls vary perpendicular to the tubes and the tube bores vary in the like manner for a more closed match of the flows and the heat inputs of individual tubes.

In particular, the invention at least accommodates areas of heat flux varying across the combustion chamber, for example across a combustion chamber wall, and for example varying in a horizontal direction along the combustion chamber wall, dependent upon relative position in the chamber and for example relative position along the combustion chamber wall. The invention varies tube bore between different tubes to accommodate different thermal regimes experienced between different tubes, rather than being concerned with thermal variation along an individual tube.

In a typical combustion chamber design comprising generally planar combustion chamber walls making up a rectangular or otherwise polygonal combustion chamber, and with burners firing from the walls, it is likely that in a given wall the heat flux will be higher in the middle and less towards the periphery of the wall in the corners (middle and peripheral regions being understood as referring to a direction transverse to the longitudinal tube direction and in the vertical tube case horizontal to the vertical tube direction). To that extent at least, the combustion chamber design is such that different tubes are subjected to different heat flux in use with higher heat flux towards the middle of a wall and in particular to a heat flux which varies in a horizontal direction along the chamber wall with higher heat flux towards the middle of a wall.

In the preferred embodiment the invention is applied to a vertical tube combustion chamber in which plural tubes are arranged generally vertically. It follows that in the preferred embodiment of the invention a combustion chamber wall as above described is adapted to accommodate this varied heat flux in that the tube bores of the furnace tubes vary in a horizontal direction along the chamber wall such as to be generally larger in the middle region of the combustion chamber wall than at the transversely peripheral regions of the combustion chamber wall.

More completely in this case the invention comprises a vertical tube steam generator having at least one combustion chamber wall comprising a plurality of longitudinally disposed furnace tubes together comprising a single fluid system for parallel passage from a common source to a common outlet of an evaporatable flow medium, connected together in gas-tight manner by tube webs;

wherein the tube bores of the furnace tubes vary in a horizontal direction along the combustion chamber wall such as to be generally larger in the middle region of the combustion chamber wall than at the transversely peripheral regions of the combustion chamber wall.

It further follows that in a further preferred embodiment of the invention, the steam generator comprises a combustion chamber having a polygonal cross-section and having combustion chamber walls extending from middle regions in a direction transverse to the tube direction, and for example in a horizontal direction transverse to a vertical tube direction, towards corners defined by the polygonal cross-section;

wherein at least one combustion chamber wall is adapted as above described in that the tube bores of the furnace tubes vary in a transverse direction along the chamber wall such as to be such as to be generally larger in the middle region of the combustion chamber wall than at the corners of the combustion chamber.

More completely in this case the invention comprises a vertical tube steam generator comprising a combustion chamber having a polygonal cross-section and having combustion chamber walls extending from middle regions in a direction transverse to the tube direction towards corners defined by the polygonal cross-section;

wherein the tube bores of the furnace tubes vary in the transverse direction along a combustion chamber wall such as to be generally larger in the middle region of the combustion chamber wall than at the transversely peripheral regions of the combustion chamber.

More completely in the vertical tube embodiment the invention comprises a vertical tube steam generator comprising a combustion chamber having a polygonal cross-section and having combustion chamber walls extending from middle regions in a horizontal direction transverse to the vertical tube direction towards corners defined by the polygonal cross-section;

wherein the tube bores of the furnace tubes vary in a horizontal direction along a combustion chamber wall such as to be generally larger in the middle region of the combustion chamber wall than at the corners of the combustion chamber.

The present invention modifies the tube bores of the furnace tubes of a single fluid system in a boiler, that is, of a single fluid system comprising a plurality of generally parallel tubes that collectively convey an evaporatable flow medium in parallel passage from a common source to a common outlet in a furnace wall direction (and for example from the bottom to the top). The invention mitigates the effect of uneven heat flux between different tubes of the same fluid system, in particular where attributable to relative location within the combustion chamber and/or on the combustion chamber wall, by taking account of the operational variations in heat flux, and seeking to match tube flows more closely to the local heat fluxes to tend to equalise the tube temperatures. Tube bore sizes in accordance with the invention are reduced at areas of lower heat flux and increased at areas of higher heat flux, in particular respectively constituting the corners and the middle regions of the walls.

The skilled person will appreciate that a reference herein to a parallel tube combustion chamber wall is understood in the art as being a reference to a class of combustion chamber wall in which a plurality of generally parallel furnace tubes are disposed. A reference to a parallel tubes combustion chamber wall will be understood to mean that the tubes connect from a common source to a common outlet. Deviation from strict parallel arrangement does not exclude from the scope of the invention to the extent that such a combustion chamber wall would still be considered a parallel tube combustion chamber wall as it would be understood in the art.

Similarly, references to a vertical tube furnace will be understood as being a reference to a class of combustion chamber wall in which a plurality of generally parallel furnace tubes are generally vertically disposed at least for a substantial part of the chamber. Again, deviation from strict parallel arrangement does not exclude from the scope of the definition to the extent that such a combustion chamber wall would still be considered a vertical tube combustion chamber wall as it would be understood in the art. In a vertical tube furnace, it will be understood that the tubes are not always strictly vertically oriented, for example tubes may bend or deviate from vertical to form a hopper.

In accordance with the invention, the bores of different tubes in the combustion chamber or combustion chamber wall vary from each other to accommodate variation in heat flux variations within the chamber and especially about the chamber wall, for example in a transverse direction, and for example from the middle to the corners. Each individual tube may be, and in many instances preferably will be, of constant bore along its length, for simplicity of design. However a tube bore may optionally be varied along its length to tackle certain issues or to optimise the design without departing from the principles underlying the invention. For example it may be desirable to enlarge tube bores towards the top to achieve flow stability. The invention is primarily concerned with the differences in heat flux experienced between tubes, in that tube bore sizes in accordance with the invention are reduced for tubes at areas of lower heat flux and increased for tubes at areas of higher heat flux, in particular in the example case respectively constituting the corners and the middle of the wall of a polygonal chamber.

This approach can be contrasted with that suggested by U.S. Pat. No. 5,979,370. U.S. Pat. No. 5,979,370 attempts to deal with variations in thermal flux by reducing the external heat transfer surface per tube towards the middle of the wall. One possible way it envisages of achieving this is by reducing the external diameter of the tube (and consequently in a possible embodiment also by reducing the internal bore of the tube) in the middle region. To the extent that the bore varies at all, the approach in U.S. Pat. No. 5,979,370 is thus specifically the reverse of that employed by the present invention.

However, such an approach fails to take account of the variations in tube flow conditions which result from a variation in tube bore. Once proper account is taken of these effects, in accordance with the applicant's invention, it is instead proposed that tubes located in the areas of higher heat flux (such as in the middle region of the wall) or otherwise subject to greater heating along their length are made larger, at least in respect of internal bore and consequently in a typical embodiment also in respect of external wall perimeter. In this way, local flow rates in the tubes match local heat fluxes to mitigate the variation in tube temperature. Thus, in accordance with the invention, furnace tubes experiencing higher heat flux have a larger bore than the furnace tubes experiencing lower heat flux.

Thus, in accordance with the preferred embodiment, furnace tubes in the middle region of the combustion chamber wall have a larger bore than the furnace tubes disposed towards the corners of the combustion chamber.

In a possible arrangement, furnace tubes in a chamber wall may be provided such that there is a successive reduction in tube bore of adjacent tubes when moving from the middle of the combustion chamber wall towards the periphery of the combustion chamber wall. Alternatively, adjacent furnace tubes in a chamber wall may be combined into groups, each comprising a plurality of adjacent tubes, wherein bores of furnace tubes making up each of said groups are identical, and bores of furnace tubes making up different groups are different. In this case, there is preferably a successive reduction in tube bore of adjacent groups of tubes when moving from the middle of the combustion chamber wall towards the periphery of the combustion chamber wall.

Typically furnace tubes having larger bores also have larger perimeters. Typically, the furnace tubes in the middle region of the combustion chamber wall have a larger perimeter than the furnace tubes towards the periphery of the combustion chamber wall.

Conveniently, given the same pressure, the bigger tubes generally have thicker walls to maintain the strength. Therefore in the preferred case the furnace tubes in the middle region of the combustion chamber wall are generally thicker than that of the furnace tubes towards the periphery of the combustion chamber wall.

Preferably, a furnace tube has a circular bore and a circular perimeter cross section. In accordance with this preferred case of the invention the furnace tubes in the middle region of the combustion chamber wall have a larger inner diameter than the furnace tubes towards the periphery of the combustion chamber wall. It is likely that the furnace tubes in the middle region of the combustion chamber wall have a larger outer diameter than the furnace tubes towards the periphery of the combustion chamber wall.

The general principles of the invention lie in the accommodation of heat flux variation between different tubes in a combustion chamber, such as may occur across a combustion chamber wall or between different combustion chamber walls. For example the invention lies in the accommodation of heat flux variation that occurs as a consequence of chamber design and firing arrangement in a direction perpendicular to a tube longitudinal direction along the combustion chamber wall of a combustion chamber, and in particular but not limited to the accommodation of heat flux variation in a horizontal direction along the combustion chamber wall of a vertical tube combustion chamber. The invention makes use of tubes having a larger bore where conditions are hottest, and especially in regions within a combustion chamber having higher heat flux, and a smaller bore where conditions are cooler, and especially in regions within a combustion chamber having a lower heat flux. At the very least, for example especially in the case of a planar wall of a polygonal combustion chamber this will typically produce an arrangement where the tube bores of the furnace tubes are larger in the middle region of the combustion chamber wall than at the corners of the combustion chamber.

It will additionally be familiar that some furnace tubes are particularly hot due to other aspects of the geometrical arrangement within the combustion chamber. In particular for example the tubes which form the circumference of burner throats tend to be both longer and subjected to more radiant heat. It will be understood that the principles of the present invention may also be employed in respect of these tubes. Tubes having larger tube bores can be used to produce the higher tube flow necessary to lower the temperature of these tubes also. A furnace tube which forms the circumference of a burner throat let into the combustion chamber wall for a part of its length may have a larger tube bore than a furnace tube which forms a planar part of the combustion chamber wall. It will be understood that such a furnace tube should have a larger tube bore for the full height of the lower furnace, between the furnace inlet headers and intermediate headers, and not just for the sections that form the burner circumferences.

The invention is equally applicable to accommodating differences in heat input between furnace walls as well as differences in heat input across a furnace wall. Thus, a furnace wall having lower heat input may have tubes having a smaller bore than a furnace wall having higher heat input.

For example for conventional rectangular furnaces, where the bottom part of both front and rear walls bend inward to form an ash hopper, the side walls have a lower heat input than the front and rear walls. The tube bores of the side wall tubes can be smaller than their equivalents the front and rear walls. Variations of heat input across the side walls may also be accommodated by variations in tube bore. The tube bores at the central parts of the side walls can additionally be bigger than the tube bores of the side wall wings for the reasons set out above. However the tube bores of the furnace tubes in the front and rear walls may still be larger than the tube bores of equivalently positioned furnace tubes in the side walls.

The plural furnace tubes making up a combustion chamber wall preferably have identical material composition. It is an advantage of the invention that tube bore size variation mitigates hot tube effects, and makes it easier to have similar tube structures throughout. The plural furnace tubes making up a combustion chamber may be evenly pitched and/or separated by even widths of web. However, the invention is not limited to such an arrangement. It is known in the art for example to vary pitch and web width, and the present invention is equally applicable to combustion chambers having such more complex arrangements of furnace tube.

The furnace tubes may comprise smooth tubes having a smooth inner surface. However, in accordance with a preferred embodiment of the invention, internally ribbed tubes are used.

In use, the surface of the tube and the surface of the web to which the tube is adjacent together form a portion of the combustion chamber wall which serves as a heat transfer surface to the flow medium within the tube. In a possible arrangement, additional heat transfer surfaces may be provided in the form of longitudinal fins on the outer surface of the tube wall.

In a usual arrangement, the furnace tubes are disposed vertically in a vertically orientated furnace wall for the upward passage of an evaporatable flow medium.

In a preferred arrangement, the combustion chamber has a substantially rectangular cross-section with combustion-chamber walls extending from middle regions towards substantially orthogonal corners.

Typically, the evaporatable flow medium is water/steam.

In a preferred arrangement, the steam generator is a once-through generator in that the furnace tubes are disposed such that in normal continuous flow operation a single pass of the flow medium in the tubes leads to substantially complete evaporation.

In a preferred arrangement, the steam generator is a supercritical steam generator adapted for operation at supercritical conditions.

Supercritical steam generators (also known as Benson boilers) are frequently used for the production of electric power. They operate at "supercritical pressure". In contrast to a "subcritical boiler", a supercritical steam generator operates at such a high pressure (over 3,200 psi/22.06 MPa or 220.6 bar) that actual boiling ceases to occur, and the boiler has no water—steam separation. There is no generation of steam bubbles within the water, because the pressure is above the "critical pressure" at which steam bubbles can form. It passes below the critical point as it does work in the steam turbine and enters the condenser. This is more efficient, resulting in slightly less fuel use. The term "boiler" is used in the art on occasion for such apparatus but is not strictly appropriate for a supercritical pressure steam generator, as no "boiling" actually occurs in this device.

Normally modern supercritical steam generators operate at sliding pressure mode. The steam pressure reduces with the boiler output. It means that supercritical steam generators still operate at subcritical pressure when boiler loads are below certain level. Boiling process occurs at subcritical pressure.

As used herein, the concept of a "steam generator" should be considered to apply to both supercritical and subcritical pressures.

In a preferred arrangement, the steam generator is adapted for once-through operation. When a once through boiler operates at once through mode, water flows, without recirculation, sequentially through the economizer, furnace wall, evaporating and superheating tubes. Boiling or evaporating ceases to occur at supercritical pressure but boiling still occurs when a once through boiler operates at subcritical pressure. It is not necessary to ensure the evaporation completes at furnace wall outlet if the down stream heating surfaces are designed for wet operation. Normally the heating surfaces downstream primary SH would not design for wet mode.

In a particular preferred case, the steam generator is adapted for use in a thermal power plant in that it is provided with, and fired in use by, a plural array of burners for carbonaceous fossil fuels, which burners pass through the respective burner throats to fire the combustion chamber. Suitable fuels include solids and especially pulverized solids, liquids, emulsions and gases, Thus, in accordance with the most complete aspect of the invention, there is also provided a thermal power plant comprising at least one steam generator as above described fired by burners as above described, with suitable fuel supply means, and in fluid communication with suitable means to generate electrical power from the steam produced by the steam generator.

The invention will now be described by way of example only with reference to FIGS. 1 to 4 of the accompanying drawings in which.

Figure 1:
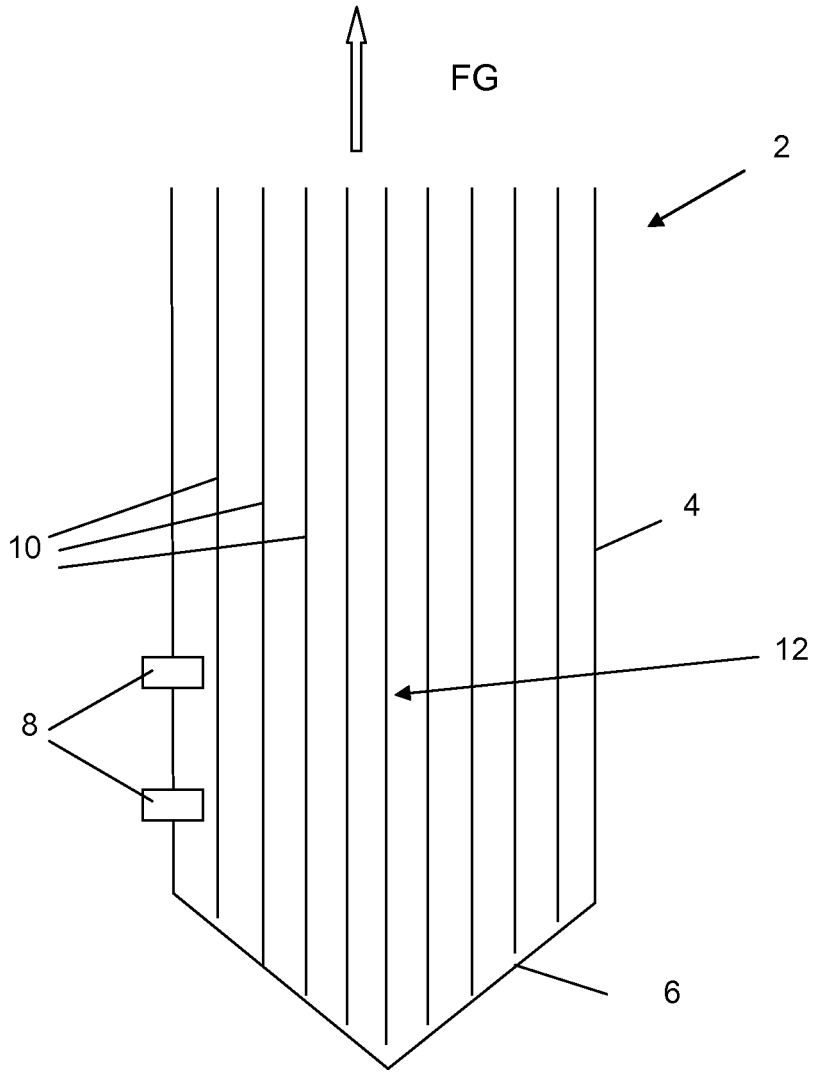
FIG. 1 is an illustration of a steam generation apparatus to which the invention could be applied.

FIG. 1 is general schematic illustration of a vertical tube steam generator to which the present invention can be applied. This is an example embodiment. The same principles can be applied to any case where the heat inputs to the tubes of the furnace enclosure walls vary perpendicular to the tubes and the tube bores vary in the like manner for a more closed match of the flows and the heat inputs of individual tubes As represented in FIG. 1 there is seen a once-through steam generator 2 having a rectangular cross section and a vertical gas flue for the exit of flue gas (FG). A combustion chamber is defined by a combustion chamber wall 4 that merges at a lower end into a bottom wall 6 defining an area for the collection of solid combustion products. The combustion chamber is fired by burners 8. In the illustrated schematic in FIG. 1 only a pair of burners is shown, at a pair of levels, but in practice burners will extend around the perimeter of the combustion chamber wall 4, and may be disposed at several levels.

Each furnace wall is defined by a plurality of vertical furnace tubes 10, of which only a small number are shown for schematic purposes. The furnace tubes are linked in gas-tight manner by intertube webs.

As is known in the art, the typical burner arrangement illustrated will produce variations in heat flux experienced by different burner tubes. In particular, a typical flame geometry will tend to produce higher heat fluxes in the centre of the walls of a rectangular combustion chamber, and lower heat fluxes transversely outward towards the corners. Whereas such temperature variations would be inherently equalized by spiral tubes, where the tubes are vertical, the same tubes experience higher heat flux for their full height.

Additionally, some tubes may experience hotter conditions because of their specific geometry. For example, although not shown in the drawings, some vertical tubes will deviate into and around the burner throats let into the combustion chamber wall 4 to allow the burners 8 to fire the combustion chamber, and either or both of the resulting extra tube length and the resulting exposure to particularly high radiant heat conditions at the burner throat may tend to produce particularly high temperature conditions for these tubes also.

Figure 2:
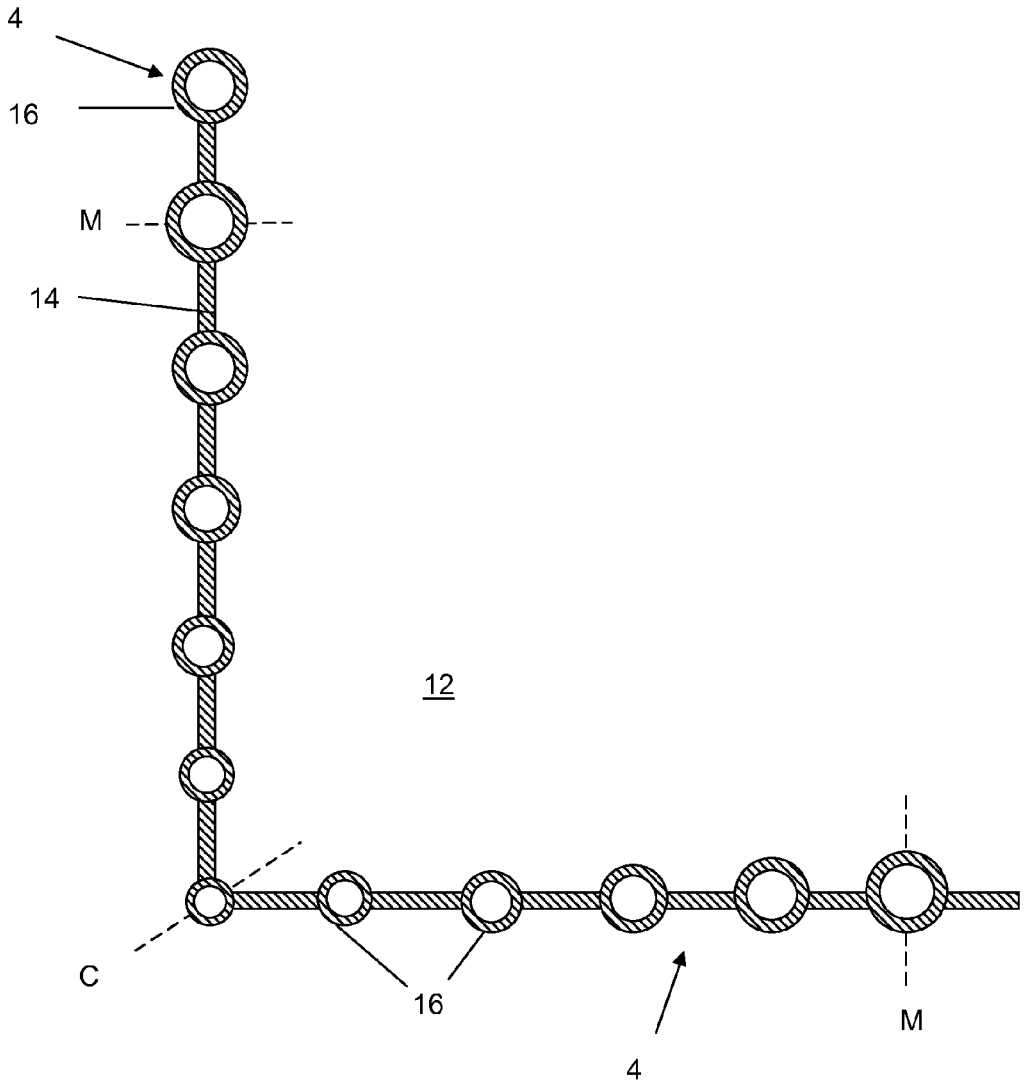
FIG. 2 illustrates an arrangement of furnace tubes such as could be included in the apparatus of FIG. 1 to embody the principles of the invention.
Figure 3:
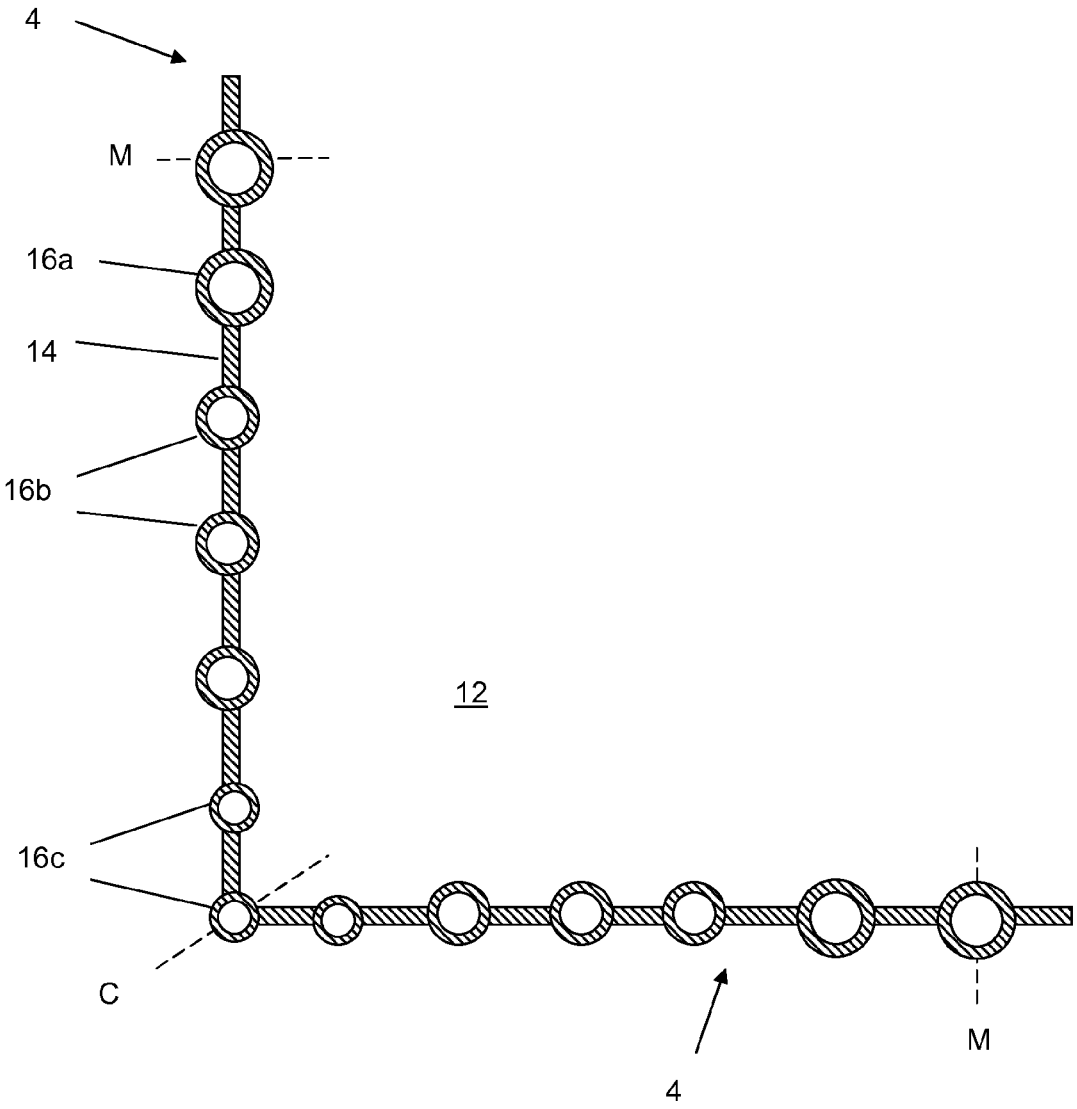
FIG. 3 illustrates an alternative arrangement of furnace tubes.

Thus, it will be appreciated that although the examples in FIGS. 2 and 3 illustrate for simplicity only how the principles in the invention might deal with variations in heat flux between the middle part of the combustion chamber wall and the corners of the combustion chamber consequent upon the particular burner arrangement of FIG. 1, it will be readily understood that the same principles could be applied to any thermal variation as between individual tubes, for example including those attributable to burner throat geometry. It will be appreciated that such considerations are not limited to the wall-fired rectangular geometry of the embodiment.

Two possible examples of tube arrangement which embody the principles of the invention to mitigate the effect of temperature variation between the middle part of a combustion chamber wall and a corner of a combustion chamber are illustrated in FIGS. 2 and 3. Again, relatively few tubes are shown for schematic purposes, but it will be understood that a real system will include a much larger plurality of individual tubes.

FIGS. 2 and 3 show the vertical tubes in cross section. In the example these tubes extend in a vertical direction with constant bore and wall perimeter surface. This arrangement may often be preferred, but the principles of the invention encompass tubes having a bore that varies along its length. Tubes in the embodiment are shown schematically with a smooth circular bore and smooth circular perimeter wall, but the invention is not limited to a particular bore or wall profile.

In each of the figures, a pair of combustion chamber walls 4 is shown extending from a rectangular corner C and away from the corner towards a middle point of the width of the wall M. As a general rule, with a typical flame geometry, the thermal flux varies in a horizontal direction along the furnace wall in that the furnace wall in the vicinity of the mid line M experiences higher thermal fluxes than is found in the corners C. For a given combustion chamber, such a variation is dependent upon chamber design and can be predicted. The present invention accommodates this in admirable manner by attempting to match water/steam flow rates to such variations in heat flux in a horizontal direction along the furnace wall so as to mitigate the extra heating effect that would otherwise tend to take place towards the middle M of the walls relative to the corner C.

In the embodiment illustrated in FIG. 2, a plurality of cylindrical furnace tubes 16 form a combustion chamber wall 4 by virtue of connection via gas-tight intertube webs 14. In the illustrated embodiment, the tubes become successive progressively larger in cross section as we move from the corner C to the middle M. This achieves the effect which characterizes the invention.

The essence of the invention is the variation in tube bore that in the embodiment is effected between the corner C and the middle M. The outside diameter of the tube conveniently also alters to maintain a proper tube thickness. In the illustrated example, the tubes are cylindrical and of similar shape so that tube bore and outer diameter vary in proportion. However, it is fundamentally the variation in tube bore horizontally across the wall, and the consequent variation in flow rate, that is the primary contributing factor to the effect which is exploited by the invention.

An alternative arrangement is illustrated in FIG. 3. In FIG. 3, to simplify the manufacturing process, cylindrical tubes are grouped by size, with each tube in a group being of the same size, but the sizes between groups varying in a step-wise manner so as to produce the same effect that generally larger diameter tubes are used at the middle M of the combustion chamber wall and generally smaller diameter tubes at the corner C of the combustion chamber. In the illustrated embodiment, a first, smallest set of tubes 16*c* is provided at and in the vicinity of the corner of the combustion chamber, a second larger set of tubes 16*b* is provided away from the corner, and a third largest set of tubes 16*a* is provided towards the middle of the combustion chamber wall. Again of course, a very small number of tubes is used for illustrative purposes and many more would be present in practice.

Above the burner zone, the heat fluxes are still higher at the central parts of the furnace walls although the heat flux profile gets flatter along the furnace height. Accordingly, and for other mass flow reasons, the tubes will typically extend in a vertical direction, typically with constant bore and typically also wall perimeter surface, although these might be variable in particular cases.

The invention is illustrated above in particular in relation to considerations attributable to burner geometrical arrangement. It will readily be appreciated that the general principles need not be restricted to such considerations.

For example, for conventional rectangular furnaces of both wall firing and corner firing arrangements, the bottom part of both front and rear walls bend inward to form the ash hopper. The heating surface area of the front and rear walls is increased to form the ash hopper but the heating surface area of the side walls is reduced by the hopper slopes. Comparing to the vertical heating surfaces, the hopper slopes are also more effective in picking up furnace radiant heat. For the reasons above, the heating surface per unit width of the side walls picks up less heat than that of the front and rear walls. The tube sizes of the side walls can be smaller than that of the front and rear walls. The same as the front and rear walls, the tubes at the central parts of the side walls can be bigger than the tubes of the side wall wings.

The invention is illustrated in particular with reference to a rectangular vertical tube once-through steam generator with a vertical flue of the type illustrated in FIG. 1. The invention is admirably applicable to such a steam generator, but it will readily be appreciated that the general principles need not be restricted to such a steam generator.

Figure 4:
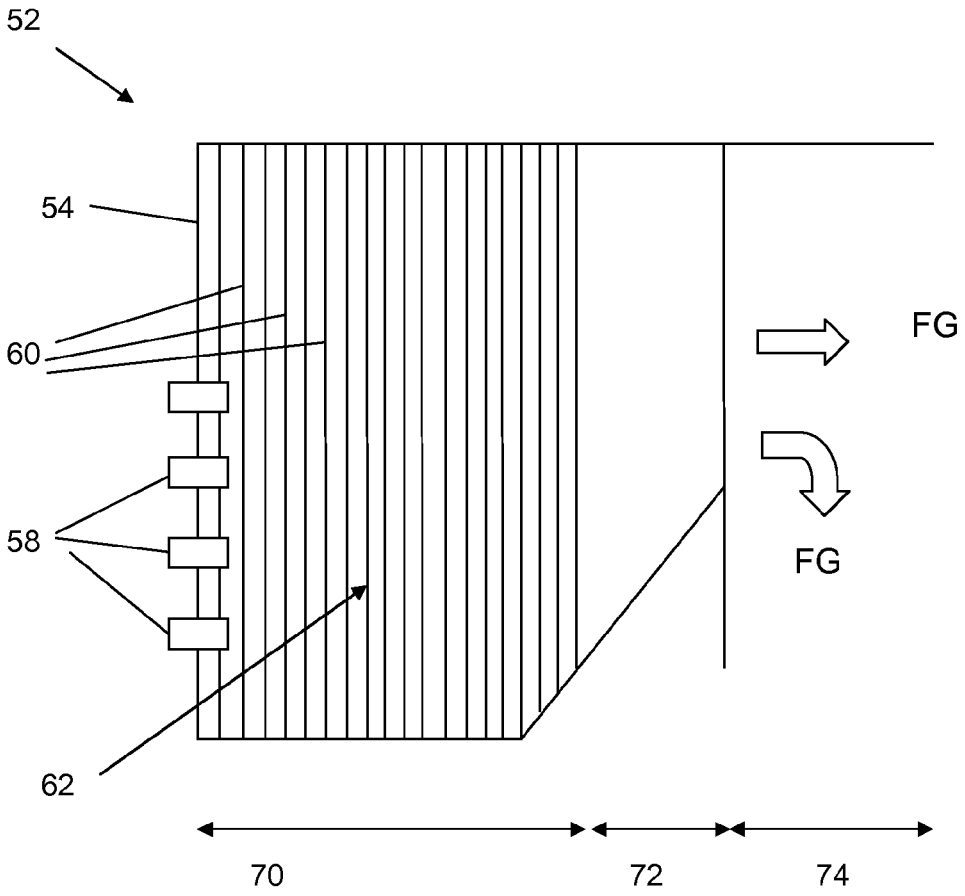
FIG. 4 is an illustration of an alternative steam generation apparatus to which the invention can be applied.

A particular alternative steam generator design is illustrated in FIG. 4.

In the embodiment in FIG. 4, a combustion chamber 70 is provided successively downstream with a horizontal flue 72 and a downstream flue 74. The flue 74 is shown incomplete.

The apparatus can be arranged so that the flue can be arranged either vertical or horizontal as shown by the two flue gas flow arrows FG.

The combustion chamber 52 is defined by combustion chamber walls 54 again comprising a plurality of vertical tubes 60 and is wall fired via burners 58. The principles of the invention set out above can readily be applied, with a knowledge of the heat flux incident on the walls of the combustion chamber, to vary tube sizes so that the tube flows again more closely matched local heat fluxes to mitigate variation in tube temperature.

For example, one possible consideration arises from the design option that the burners can be arranged either on the front wall as shown in FIG. 4 or on the front part of the side walls. On both roof and front wall of the furnace, the heat fluxes are higher at the centre and lower towards the wings. Along the gas flow direction on the side walls of the furnace, the heat fluxes vary significantly. The heat fluxes at the vicinity of the burners can be a few times greater than that close to the end away from the burners. Varying tube sizes to match the tube water/steam flows to the local heat inputs is a very effective way to even the tube temperatures for all the enclosure walls of horizontal boilers. It is almost essential for the side walls.

It will be understood that the principles of the invention could be applied in any situation where, whether as a consequence of overall combustion chamber geometry or the specific geometry experienced by a particular tube, a tube was known to be subject to a higher heat flux or otherwise to greater overall heat input along its length, in order to mitigate the effect of that greater overall heat input so as to equalize tube temperatures throughout the combustion chamber during use.

The invention claimed is:

1. A steam generator comprising:

a combustion chamber having a polygonal cross-section formed by combustion chamber walls, wherein at least one of the combustion chamber walls of the combustion chamber comprises a plurality of separate furnace tubes that extend in a longitudinal direction of the combustion chamber and is configured to provide a single fluid system for parallel passage of an evaporable flow medium in the furnace tubes in a single same direction with respect to the combustion chamber from a common source to a common outlet of the combustion chamber;

tube webs provided between adjacent ones of the furnace tubes which connect the furnace tubes together in a gas-tight manner;

wherein the combustion chamber is configured so that the furnace tubes located in a middle region of the at least one combustion chamber wall, as viewed in a direction transverse to the longitudinal direction of the combustion chamber, are subjected to higher heat input levels than the furnace tubes located in end regions of the combustion chamber wall where said combustion chamber wall forms corners regions with adjacent combustion chamber walls when the steam generator is in use; and wherein tube bores of the furnace tubes vary in size in the direction transverse to the longitudinal direction of the combustion chamber along the at least one combustion chamber wall so that diameters of the tube bores of the furnace tubes located in the middle region of the at least one combustion chamber wall are larger than diameters of the tube bores located in the end regions of the at least one combustion chamber wall, wherein the furnace tubes in the at least one combustion chamber wall are such that there is a successive reduction in the tube bore between each adjacent tube from the middle region of the at least one combustion chamber wall towards the end regions of the at least one combustion chamber wall.

2. A steam generator in accordance with claim 1 wherein the combustion chamber walls extend from middle regions transversely towards the combustion chamber corner regions which are defined by the polygonal cross-section.

3. A steam generator in accordance with claim 1 wherein the furnace tubes having larger diameters also have larger tube wall perimeters than the furnace tubes having the smaller diameters.

4. A steam generator in accordance with claim 1 wherein the furnace tubes have a circular bore and a circular perimeter cross section.

5. A steam generator in accordance with claim 4 wherein the furnace tubes in the middle region of the at least one combustion chamber wall have a larger inner diameter and a larger outer diameter than the furnace tubes at the end regions of the at least one combustion chamber wall.

6. A steam generator in accordance with claim 1 wherein a furnace tube subject to higher than average heat input due to its geometrical arrangement within the combustion chamber has a larger tube bore than a furnace tube subject to a lower heat input due to its geometrical arrangement within the combustion chamber.

7. A steam generator in accordance with claim 6 wherein a furnace tube which forms the circumference of a burner throat let into the at least one combustion chamber wall for a part of its length has a larger tube bore than a furnace tube which forms a planar part of the at least one combustion chamber wall.

8. A steam generator in accordance with claim 1 wherein a middle region of all of combustion chamber walls includes tube bores of the furnace tubes that are larger than the tube bores of the furnace tubes in the corner regions of the combustion chamber.

9. A steam generator in accordance with claim 8 wherein the polygonal cross section of the combustion chamber is a rectangular cross section and the combustion chamber walls of the rectangular combustion chamber consist of a front wall, a rear wall, and side walls, wherein tube bores of furnace tubes in the front and rear walls are larger than tube bores of equivalent furnace tubes in the side walls.

10. A steam generator in accordance with claim 1 wherein the furnace tubes are disposed vertically in a vertically orientated combustion chamber wall for the upward passage of the evaporable flow medium.

11. A steam generator in accordance with claim 1 arranged for once-through operation in that the furnace tubes are disposed such that in normal continuous flow operation a single pass of the flow medium in the tubes leads to substantially complete evaporation.

12. A steam generator in accordance with claim 1 adapted for use in a thermal power plant in that it is provided with, and fired in use by, an array of burners for carbonaceous fossil fuels, wherein said burners pass through respective burner throats to fire the combustion chamber.

13. A thermal power plant comprising at least one steam generator in accordance with claim 1 provided with burners to fire into the combustion chamber thereof and fuel supply means to supply combustible fuel to the burners, wherein the steam generator is in fluid communication with suitable means to generate electrical power from steam produced by the steam generator.

14. A steam generator comprising:

a combustion chamber having a polygonal cross-section formed by combustion chamber walls, wherein at least one of the combustion chamber walls of the combustion chamber comprises a plurality of separate furnace tubes that extend in a longitudinal direction of the combustion chamber and is configured to provide a single fluid system for parallel passage of an evaporable flow medium in the furnace tubes in a single same direction with respect to the combustion chamber from a common source to a common outlet of the combustion chamber;

tube webs provided between adjacent ones of the furnace tubes which connect the furnace tubes together in a gas-tight manner;

wherein the combustion chamber is configured so that the furnace tubes located in a middle region of the at least one combustion chamber wall, as viewed in a direction transverse to the longitudinal direction of the combustion chamber, are subjected to higher heat input levels than the furnace tubes located in end regions of the combustion chamber wall where said combustion chamber wall forms corners regions with adjacent combustion chamber walls when the steam generator is in use; and wherein tube bores of the furnace tubes vary in size in the direction transverse to the longitudinal direction of the combustion chamber along the at least one combustion chamber wall so that diameters of the tube bores of the furnace tubes located in the middle region of the at least one combustion chamber wall are larger than diameters of the tube bores located in the end regions of the at least one combustion chamber wall, wherein the furnace tubes in the at least one combustion chamber wall are divided into at least three groups, wherein diameters of the tube bores within each of said groups are identical, and the tube bores making up a first group of the tube bores is located at the end regions, the diameters of the tube bores making a second group of the tube bores are larger than the diameters of the first group, and diameters of the tube bores making a third group of the tube bores are larger than the second group and is located at the middle region, wherein the second group of the tube bores is located between the first group and the third group, as viewed along the transverse direction.

15. A steam generator in accordance with claim 14 wherein the combustion chamber walls extend from middle regions transversely towards the combustion chamber corner regions which are defined by the polygonal cross-section.

16. A steam generator in accordance with claim 14 wherein the furnace tubes have a circular bore and a circular perimeter cross section.

17. A steam generator in accordance with claim 16 wherein the furnace tubes in the middle region of the at least one combustion chamber wall have a larger inner diameter and a larger outer diameter than the furnace tubes at the end regions of the at least one combustion chamber wall.

18. A steam generator in accordance with claim 14 wherein a furnace tube subject to higher than average heat input due to its geometrical arrangement within the combustion chamber has a larger tube bore than a furnace tube subject to a lower heat input due to its geometrical arrangement within the combustion chamber.

19. A steam generator in accordance with claim 18 wherein a furnace tube which forms the circumference of a burner throat let into the at least one combustion chamber wall for a part of its length has a larger tube bore than a furnace tube which forms a planar part of the at least one combustion chamber wall.

20. A steam generator in accordance with claim 14 wherein a middle region of all combustion chamber walls includes tube bores of the furnace tubes that are larger than the tube bores of the furnace tubes in the corner regions of the combustion chamber.

21. A steam generator in accordance with claim 20 wherein the polygonal cross section of the combustion chamber is a rectangular cross section and the combustion chamber walls of the rectangular combustion chamber consist of a front wall, a rear wall, and side walls, wherein tube bores of furnace tubes in the front and rear walls are larger than tube bores of equivalent furnace tubes in the side walls.

22. A steam generator in accordance with claim 14 wherein the furnace tubes are disposed vertically in a vertically orientated combustion chamber wall for the upward passage of the evaporable flow medium.

23. A steam generator in accordance with claim 14 arranged for once-through operation in that the furnace tubes are disposed such that in normal continuous flow operation a single pass of the flow medium in the tubes leads to substantially complete evaporation.

24. A steam generator in accordance with claim 14 adapted for use in a thermal power plant in that it is provided with, and fired in use by, an array of burners for carbonaceous fossil fuels, wherein said burners pass through respective burner throats to fire the combustion chamber.

25. A thermal power plant comprising at least one steam generator in accordance with claim 14 provided with burners to fire into the combustion chamber thereof and fuel supply means to supply combustible fuel to the burners, wherein the steam generator is in fluid communication with suitable means to generate electrical power from steam produced by the steam generator.

* * * * *